US007530387B2

(12) United States Patent
Watanabe

(10) Patent No.: US 7,530,387 B2
(45) Date of Patent: May 12, 2009

(54) HEAT EXCHANGERS

(75) Inventor: Akimichi Watanabe, Isesaki (JP)

(73) Assignee: Sanden Corporation, Isesaki-shi, Gunma (JP)

( * ) Notice: Subject to any disclaimer, the term of this patent is extended or adjusted under 35 U.S.C. 154(b) by 628 days.

(21) Appl. No.: 11/127,199

(22) Filed: May 12, 2005

(65) Prior Publication Data

US 2005/0252646 A1 Nov. 17, 2005

(30) Foreign Application Priority Data

May 13, 2004 (JP) ..... 2004-143727

(51) Int. Cl.
*F28F 7/00* (2006.01)

(52) U.S. Cl. ..... 165/76; 165/173; 165/177; 165/178

(58) Field of Classification Search ..... 165/76, 165/140, 152, 153, 173, 174, 175, 176, 177, 165/178; 29/890.03, 890.053
See application file for complete search history.

(56) References Cited

U.S. PATENT DOCUMENTS

| | | | | |
|---|---|---|---|---|
| 4,360,060 | A * | 11/1982 | Collgon | 165/173 |
| 5,941,303 | A * | 8/1999 | Gowan et al. | 165/176 |
| 6,019,169 | A * | 2/2000 | Ruppel et al. | 165/166 |
| 6,332,495 | B1 * | 12/2001 | Jamison et al. | 165/153 |
| 6,612,031 | B2 * | 9/2003 | Rhodes et al. | 29/890.053 |
| 6,830,100 | B2 * | 12/2004 | Gowan et al. | 165/173 |

* cited by examiner

*Primary Examiner*—Ljiljana (Lil) V Ciric
(74) *Attorney, Agent, or Firm*—Baker Botts L.L.P.

(57) ABSTRACT

A heat exchanger comprising a first tank, a second tank, and a plurality of flat heat transfer tubes connected to the first tank and to the second tank, placing the pair of tanks in fluid communication. The heat exchanger further comprises at least one rib extending from one of an outer surface and an inner surface an inner surface of one of the plurality of flat heat transfer tubes and at least one stopper extending from the outer surface of the one of the plurality of flat heat exchanger tubes. Each of the at least one stoppers is positioned between one of the at least one ribs and one of the first tank and the second tank.

18 Claims, 10 Drawing Sheets

HEAT EXCHANGERS

BACKGROUND OF THE INVENTION

1. Field of the Invention

The present invention relates to heat exchangers, and more specifically, to heat exchangers in which a plurality of heat transfer tubes are inserted into tube insertion holes formed through each of a pair of tanks. Such heat exchangers are suitable for use in an air conditioning system for vehicles.

2. Description of Related Art

Heat exchangers having a pair of tanks and a plurality of flat, heat transfer tubes interconnecting the tanks are known. Such heat exchangers may be manufactured by temporarily assembling respective parts and brazing together the assembled parts in a furnace at the same time. In the manufacture of such heat exchangers, for example, as depicted in FIG. 14, end portions of flat, heat transfer tubes 103 are inserted into respective tube insertion holes 102 formed through a seat plate 101 of a tank 100. Fins 104 are interposed between adjacent heat transfer tubes 103.

In such heat exchangers, however, a variety of insertion lengths of respective heat transfer tubes 103 into tank 100 may occur. If the insertion length of heat transfer tube 103 is too long (for example, as in portions P1), flow resistance in tank 100 may increase. On the other hand, if the insertion length of heat transfer tube 103 is too short (for example, as in portions P2), the area for brazing between the outer surface of heat transfer tube 103 and the inner surface of tube insertion hole 102 may decrease, thereby reducing the strength of the bond. Further, although heat transfer tubes 103 and fins 104 are held by a jig (not shown) from both sides in their stacked direction when the assembled parts are brazed together in a furnace, because of a difference in the coefficient of thermal expansion between the steel jig and the parts of the heat exchanger constructed from an aluminum material or the like, the heat exchanger may be crimped strongly by the jig, and the end portions of heat transfer tubes 103 may be deformed.

In response to this problem, a structure, as depicted in FIGS. 15-17, is proposed in Japanese Patent Application Publication No. JP-A-2-242095, wherein portions 106 protruding outwardly from heat transfer tube 105 and extending across the width or in a radial direction of heat transfer tube 105 are formed on both end portions of heat transfer tube 105. By this configuration, the tube insertion lengths of the respective tubes 105 are made more uniform, and a positional shift between the tubes and the tanks is prevented.

In such heat exchangers, however, if heat transfer tube 105 is inserted forcibly, tube insertion hole 102 of seat plate 101 may be deformed, and the inner surface of the deformed tube insertion hole 102 overlap protruded portion 106. Consequently, the tube insertion length may not be regulated. Further, at that time, if a large force operates from the inner surface side of tube insertion hole 102 against protruded portion 106, tube 105 may be deformed. If the heat transfer tube 105 is deformed, a decrease in brazing strength or an increase in flow resistance, or both, may occur.

SUMMARY OF THE INVENTION

Accordingly, a need has arisen to provide an improved structure of a heat transfer tube of a heat exchanger, which may prevent a deformation of a tube end portion, and may prevent an increase in flow resistance and avoid a decrease in brazing strength, thereby providing a heat exchanger capable of higher performance.

To achieve the foregoing and other objects, a heat exchanger according to the present invention comprises a pair of tanks and a plurality of flat, heat transfer tubes which place the pair of tanks in communication by inserting each end portion of a heat transfer tube into one of the tanks and extending in parallel to each other. The heat exchanger comprises a rib protruding in at least one of an outward and an inward direction (i.e., away from the interior of the heat exchanger tube or toward the interior of the heat exchanger tube, respectively), from the heat transfer tube and a stopper regulating an insertion length of the heat transfer tube into a tank, which rib and stopper are provided on a surface of an end portion of the heat transfer tube.

In the heat exchanger, the heat transfer tube comprises a rib protruding in at least one of outer and inner directions of the heat transfer tube and a stopper regulating an insertion length of the heat transfer tube into the tank. Therefore, for example, by means of a rib extending across the width of the heat transfer tube, the strength of the end portion of the heat transfer tube primarily is increased, and a deformation of the heat transfer tube may be reduced or prevented. On the other hand, for example, by engaging a stopper, which protrudes in an outward direction of the heat transfer tube, against an inner surface of a tube insertion hole, the insertion length of the heat transfer tube into a tank may be regulated at a proper length. Therefore, because both a uniform tube insertion length and an increase of the strength of the end portion of the heat transfer tube may be achieved simultaneously and effectively, a higher performance heat exchanger is provided, which avoids an increase of the flow resistance within the tanks and which has superior brazing strength.

The rib may protrude in either of the outward or inward direction from the heat transfer tube. If the rib protrudes in the inward direction of the heat transfer tube, the rib may regulate a position of an inner fin, which may be disposed within the heat transfer tube, in the axial or longitudinal direction of the heat transfer tube.

The rib preferably extends across a width or transverse to the axis of the heat transfer tube. By such a structure, the strength of the end portion of the heat transfer tube may be increased over a broader area, and a deformation of the tube may be reduced or prevented more properly. Although the extension length of such a rib is not particularly limited, for example, about one-third of the width of the flat, heat transfer tube may be sufficient to achieve the desired rib function.

The stopper may have, for example, a convex shape and may protrude outwardly from the surface of the end portion of the heat transfer tube.

The number and disposition of the ribs or stoppers, or both, are not particularly restricted. For example, stoppers may be disposed at each side of the rib(s) across a width of the heat transfer tube. Alternatively, a plurality of ribs may be disposed on the surface of the end portion of the heat transfer tube, and at least one stopper may be disposed between a pair of ribs.

With respect to the positional relationship between the rib and the stopper, at least a portion of the stopper extends toward an end of the heat transfer tube beyond the rib(s). In such a heat exchanger, when the end portion of a tube is inserted into a tube insertion hole of a tank, because a portion of the stopper first comes into contact with the inner surface of the tube insertion hole and because an excessive insertion of the tube is regulated, disadvantages, such as a deformation of the tube where an excessive force is received at the inner surface of the tube insertion hole by the rib, may be reduced or avoided. In order to extend at least a portion of the stopper toward an end of the heat transfer tube beyond the rib(s), a dimension of the stopper in an axial or a longitudinal direction of the heat transfer tube may be greater than a dimension of the rib(s) in the axial or longitudinal direction of the heat transfer tube. For example, a diameter of the stopper may be greater than a depth of the rib(s).

Further, the rib(s) and the stopper(s) may be disposed so as to be connected to each other, e.g., configured integrally. Alternatively, the rib(s) and the stopper(s) may be disposed so as to be independent or separated from each other. Such rib(s) and stopper(s), e.g., configured integrally, may be formed readily by a single process, for example, by pressing.

In the heat exchanger according to the present invention, because a uniform tube insertion length and because an increase of the strength of the end portion of the heat transfer tube both may be achieved simultaneously and effectively, a higher performance heat exchanger, which prevents an increase of the flow resistance in the tanks and has superior brazing strength, may be achieved. Such a higher performance heat exchanger may be applied to a variety of uses for known heat exchanger and, in particular, is suitable as a heat exchanger for use in air conditioning systems for vehicles.

Further objects, features, and advantages of the present invention will be understood from the following detailed description of preferred embodiments of the present invention with reference to the accompanying figures.

BRIEF DESCRIPTION OF THE DRAWINGS

Embodiments of the invention now are described with reference to the accompanying figures, which are given by way of example only, and are not intended to limit the present invention.

DETAILED DESCRIPTION OF PREFERRED EMBODIMENTS

Figure 1:
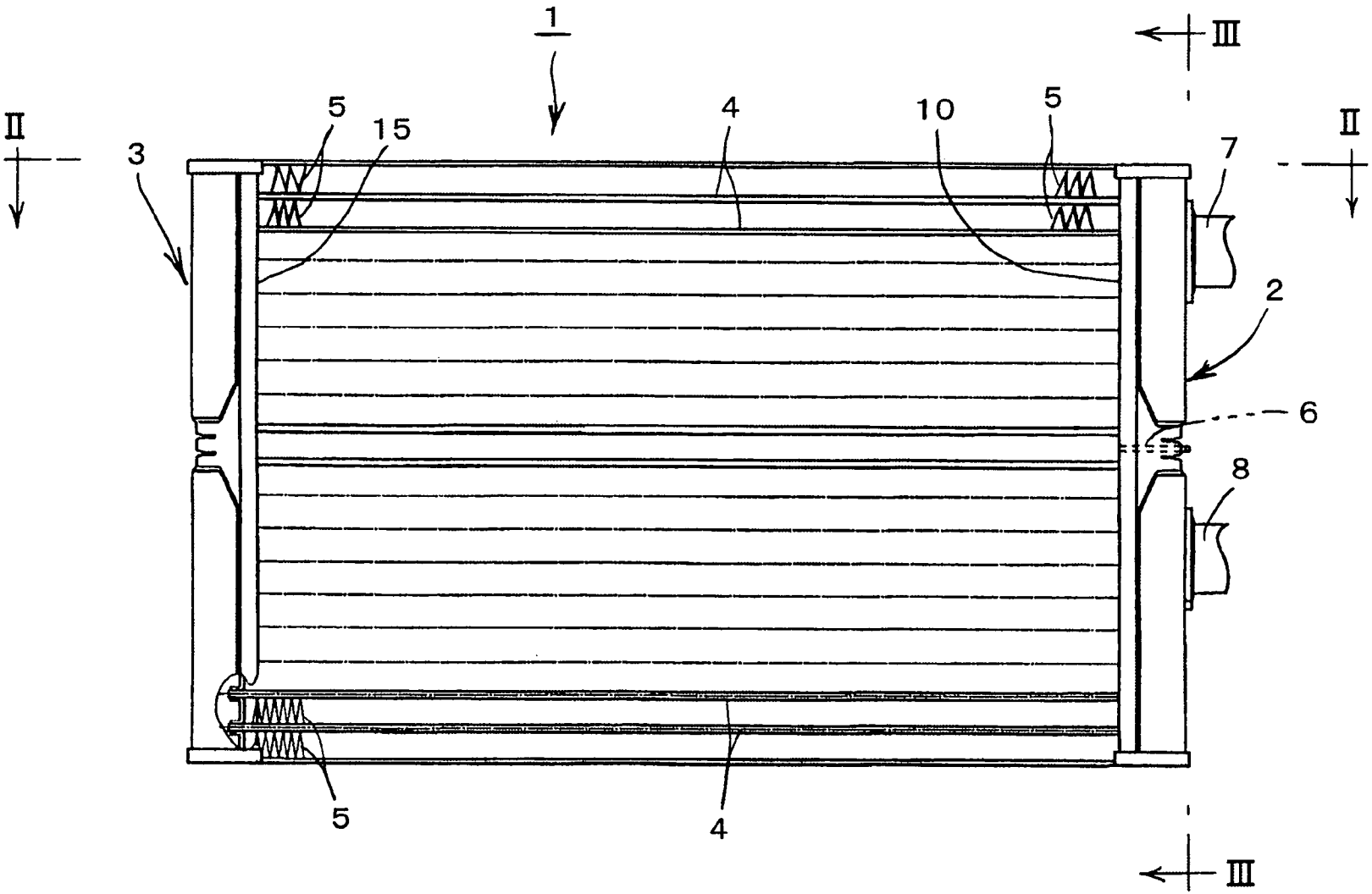
FIG. 1 is a plan view of a heat exchanger according to a first embodiment of the present invention.
Figure 2:
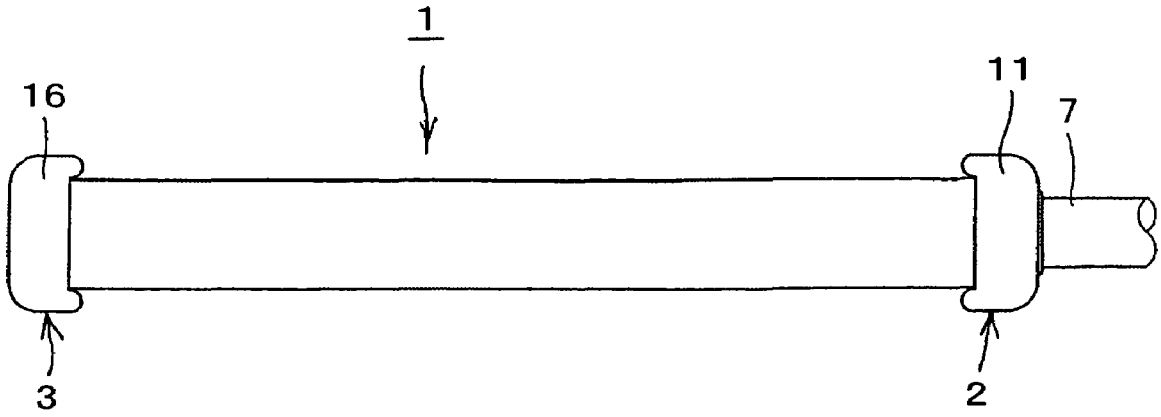
FIG. 2 is a first side view of the heat exchanger depicted in FIG. 1, as viewed along a line II-II of FIG. 1.
Figure 3:
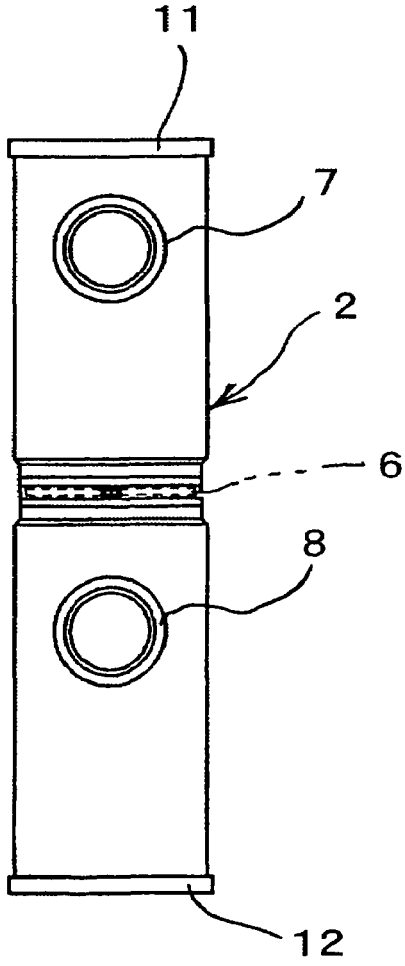
FIG. 3 is a second side view of the heat exchanger depicted in FIG. 1, as viewed along a line III-III of FIG. 1.

FIGS. 1-8 depict a heat exchanger according to a first embodiment of the present invention. In FIGS. 1-4, heat exchanger 1 comprises a pair of tanks 2 and 3 and a plurality of flat, heat transfer tubes 4 placing tanks 2 and 3 in communication. Flat, heat transfer tubes 4 extend in parallel to each other. Each end portion of heat transfer tube 4 is inserted into one of tanks 2 and 3 to place tanks 2 and 3 in communication. Corrugated fins 5 are interposed between adjacent, heat transfer tubes 4.

Figure 4:
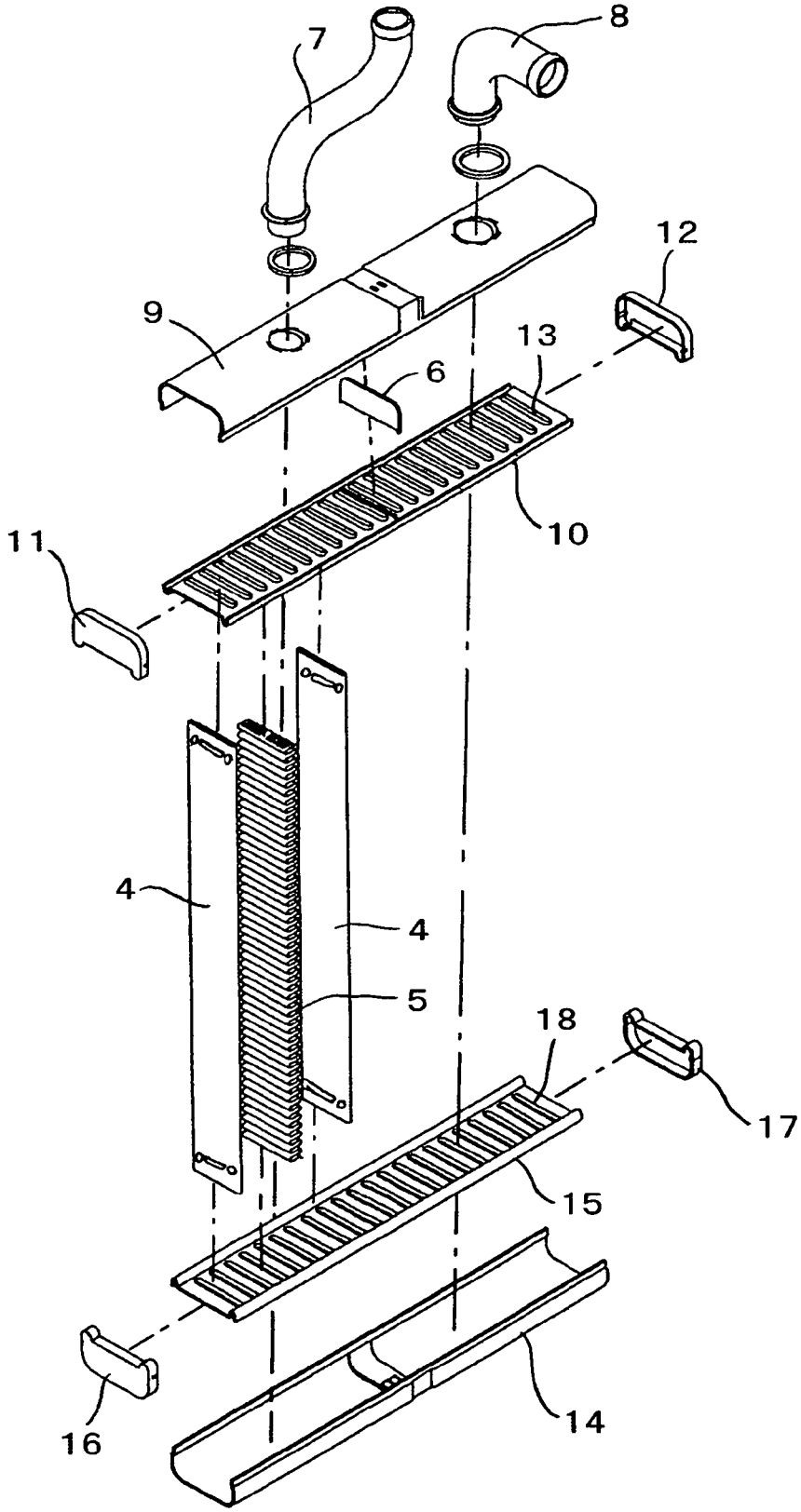
FIG. 4 is a partial, exploded, perspective view of the heat exchanger depicted in FIG. 1.

As depicted in FIG. 4, tank 2 is formed from tank member 9, seat plate 10, and caps 11 and 12. A plurality of slot-like, tube insertion holes 13, into which the end portions of respective flat, heat transfer tubes 4 are inserted, are disposed through seat plate 10. Barred portion 19 (depicted in FIG. 5) surrounds each tube insertion hole 13. The inside of tank 2 is divided into two chambers by a partition 6. An inlet pipe 7 is in communication with one chamber, and an outlet pipe 8 is in communication with the other chamber. Tank 3 is similar to tank 2, and as depicted in FIG. 4, tank 3 is formed from tank member 14, seat plate 15, and caps 16 and 17. A plurality of slot-like, tube insertion holes 18, into which the end portions of respective flat, heat transfer tubes 4 are inserted, are disposed through seat plate 15. Barred portion 19 (depicted in FIG. 5) is formed around each tube insertion hole 18.

Figure 6:
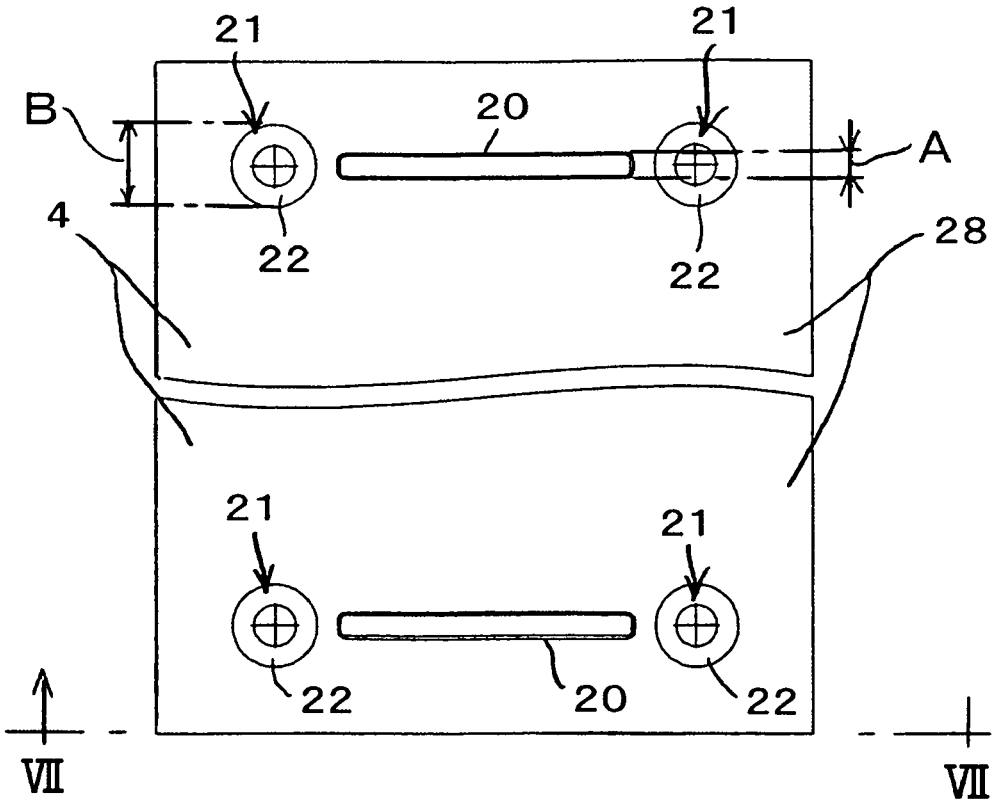
FIG. 6 is an enlarged, partial, plan view of a flat, heat transfer tube of the heat exchanger depicted in FIG. 1.
Figure 7:
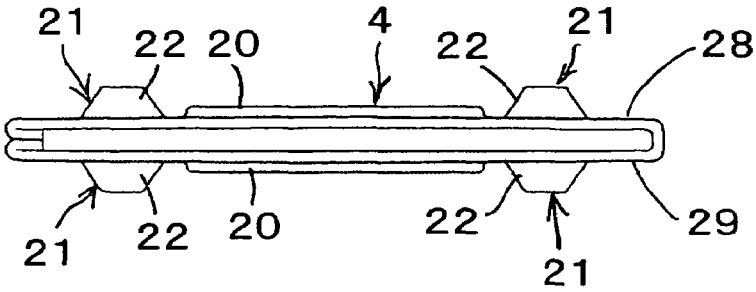
FIG. 7 is a cross-sectional view of the heat transfer tube depicted in FIG. 6, as viewed along line VII-VII of FIG. 6.

As depicted in FIGS. 6 and 7, ribs 20 and stoppers 21 are disposed on both surfaces 28 and 29 of each end portion of each flat, heat transfer tube 4. Each rib 20 protrudes from the tube surface in an outward direction from heat transfer tube 4. Each stopper 21 regulates a tube insertion length of each heat transfer tube 4 into each tube insertion hole 13 or 18.

In this embodiment, rib 20 extends across a width of flat, heat transfer tube 4 (e.g., a left/right direction in FIG. 6). Rib 20 and each stopper 21 are independent or separated from each other. Although the extension length of rib 20 is not particularly limited, it may be about one third of the width of flat, heat transfer tube 4. Stopper 21 is a convex-shaped protrusion 22 from the tube surface in an outward direction from flat, heat transfer tube 4. In this embodiment, stoppers 21 are disposed on each side of rib 20 in the transverse direction (i.e., across the width) of rib 20.

Figure 8:
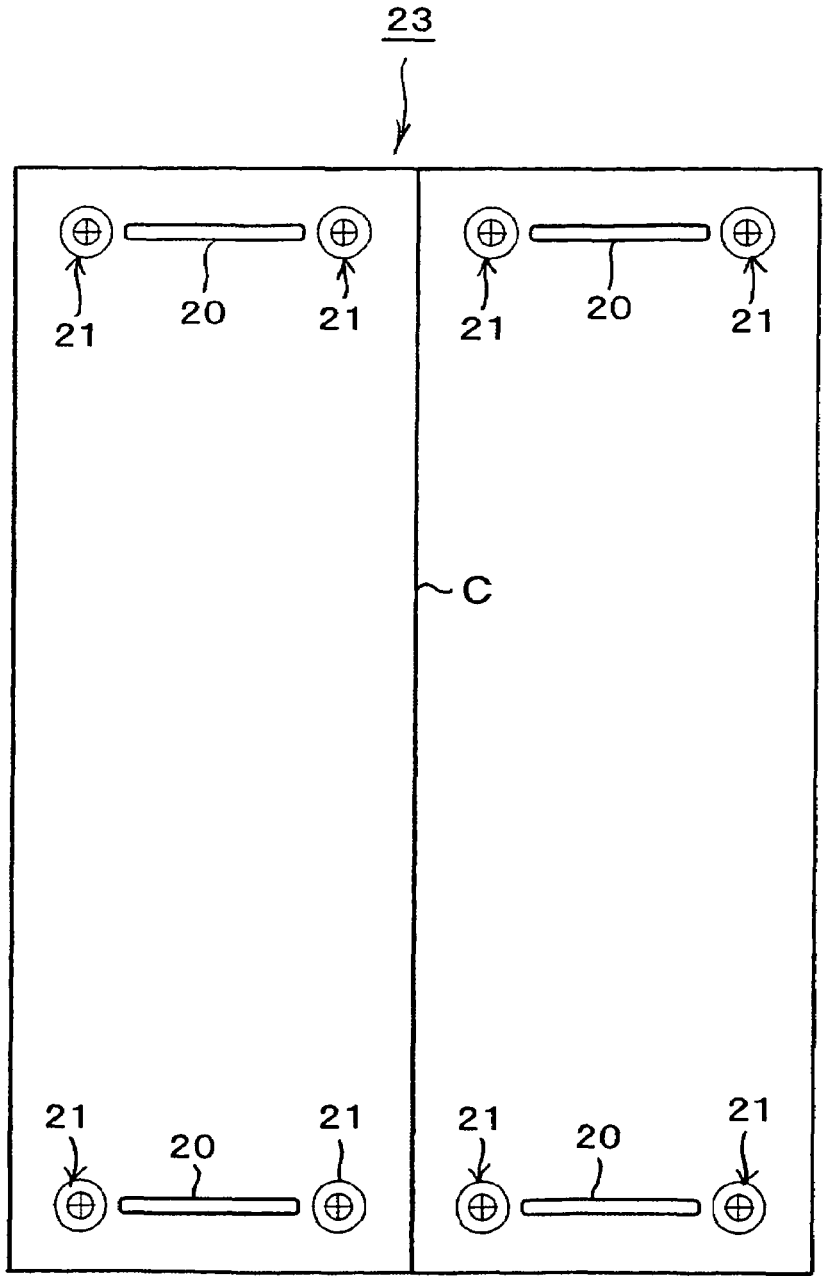
FIG. 8 is a plan view of a plate material for forming the heat transfer tube depicted in FIG. 7.

In this embodiment, at least a portion of stopper 21 extends toward an end of flat, heat transfer tube 4 beyond rib 20. This structure is achieved by setting a dimension B (a diameter) of stopper 21 greater than a dimension A (a depth) of rib 20 in the longitudinal direction of flat, heat transfer tube 4 (a vertical direction in FIG. 6). Such ribs 20 and stoppers 21 may be formed readily by a single process, such as by pressing. In this embodiment, as depicted in FIG. 8, flat, heat transfer tube 4 may be formed by forming ribs 20 and stoppers 21 on four corners of a single plate material 23, and folding the plate material 23 along a folding line C.

Figure 5:
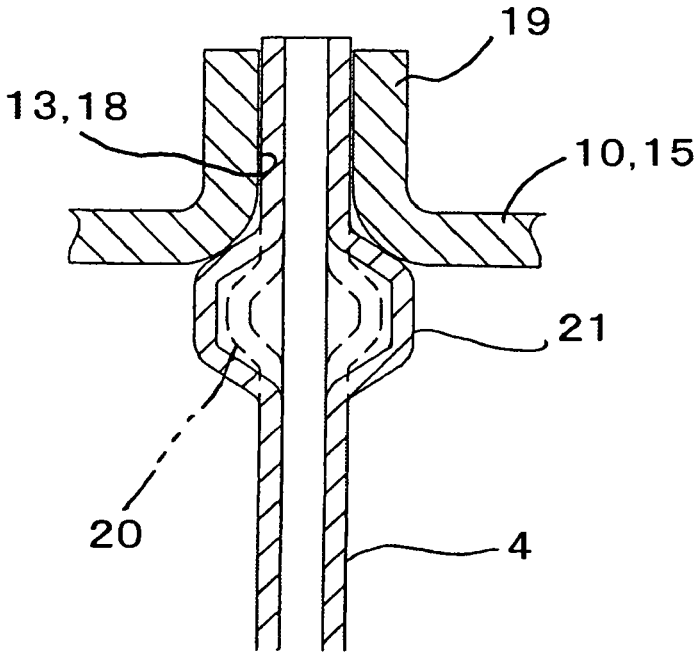
FIG. 5 is an enlarged, partial, cross-sectional view of the heat exchanger depicted in FIG. 1, showing a flat, heat transfer tube inserted into a tube insertion hole of a tank.

In such heat exchangers 1 which comprise flat, heat transfer tubes 4, each having ribs 20 protruded in the outward direction from heat transfer tube 4 and stoppers 21 regulating insertion lengths of heat transfer tubes 4 into tanks 2 and 3, ribs 20 extending in across the width of the tube increase the strength of each end portion of tubes 4, thereby preventing a deformation thereof Stoppers 21 primarily regulates the tube insertion length of each end portion of flat, heat transfer tubes 4 into tube insertion holes 13 or 18 by engaging stoppers 21 with the inner surface of tube insertion holes 13 or 18, as depicted in FIG. 5. Therefore, an increase of the strength of each end portion of flat, heat transfer tubes 4 and a uniform tube insertion length of each end portion of flat, heat transfer tubes 4 into tank 2 or 3 may be achieved simultaneously and effectively; and a higher performance heat exchanger 1, which has superior brazing strength and which may prevent an increase of flow resistance, may be realized.

Further, because ribs 20 extend across the width of flat, heat transfer tubes 4, the strength of each end portion of tubes 4 may be increased over a broader area, and deformation of tubes 4 may be properly reduced or prevented. Although such an extension length of ribs 20 is not particularly limited, as long as the length is at least about one-third of the width of flat, heat transfer tube 4, ribs 20 may be sufficient to achieve the desired function.

Moreover, in this embodiment, because at least a portion of stopper(s) 21 extends toward an end of flat, heat transfer tube 4 beyond rib(s) 20, when the end portion of heat transfer tube 4 is inserted into tube insertion hole 13 or 18 of tank 2 or 3, respectively, the outer edge(s) of stopper(s) 21 first comes into contact with the inner surface of tube insertion hole 13 or 18. Therefore, the insertion length of heat transfer tubes 4 is regulated properly, and an excessive insertion may be prevented. Consequently, rib 20 does not receive excessive stress from the inner surface of tube insertion hole 13 or 18, and the end portion of heat transfer tube 4 may not be deformed.

In addition, in this embodiment, because stoppers 21 may be provided on each side of rib(s) 20 in the transverse direction of rib 20, the orientation of flat, heat transfer tube 4, when the end portion of the tube is inserted into tube insertion hole 13 or 18, may be maintained properly.

Figure 9:
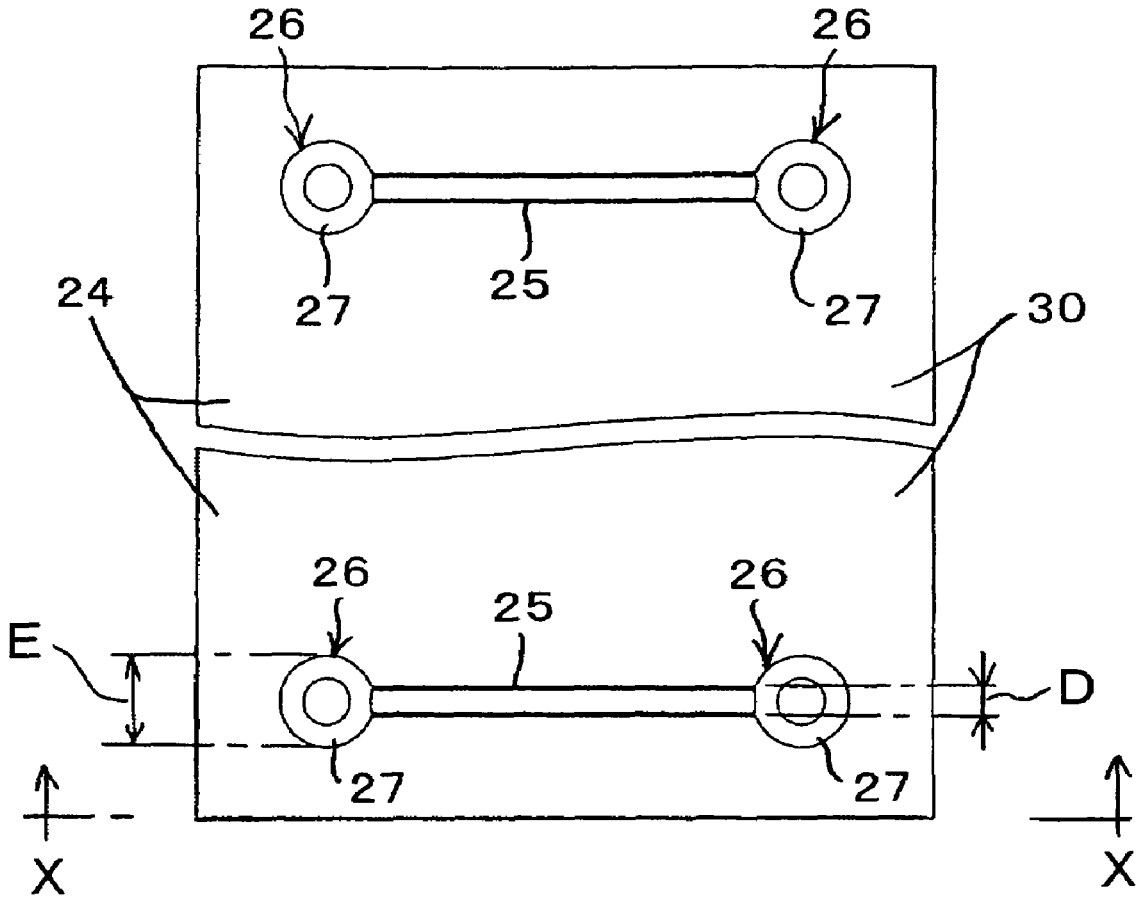
FIG. 9 is a partial, plan view of a flat, heat transfer tube of a heat exchanger according to a second embodiment of the present invention.
Figure 10:
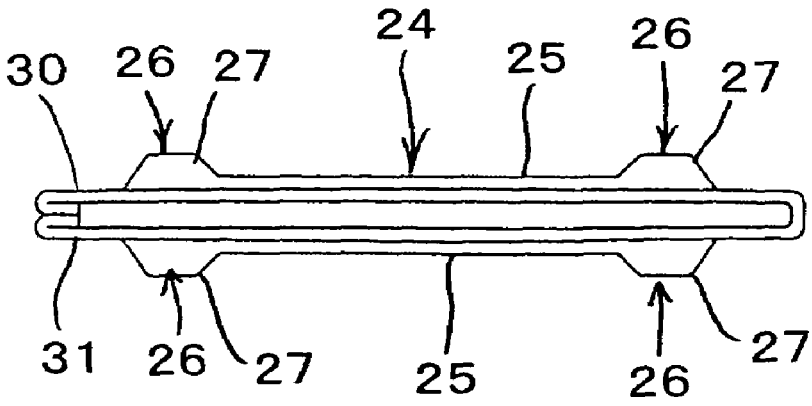
FIG. 10 is a cross-sectional view of the heat transfer tube depicted in FIG. 9, as viewed along line X-X of FIG. 9.

FIGS. 9 and 10 depict a flat, heat transfer tube 24 of heat exchanger 1 according to a second embodiment of the present invention. In this embodiment, ribs 25 and stoppers 26 are disposed on both surfaces 30 and 31 of each end portion of each flat heat transfer tubes 24. Each rib 25 protrudes from the tube surface in an outward direction from heat transfer tube 24. Each stopper 21 regulates a tube insertion length of heat transfer tube 24 into each tube insertion hole 13 or 18 of tank 2 or 3, respectively.

In this embodiment, each rib 25 extends across a width of flat, heat transfer tube 24 (e.g., a left/right direction in FIG. 9), and each stopper 26 is a convex-shaped protrusion 27 from the tube surface in the outward direction from flat, heat transfer tube 24. Stoppers 26 may be disposed on each side of each rib 25 in the transverse direction of rib 25, and stoppers 26 and rib 25 are connected continuously to each other.

At least a portion of stopper 26 extends toward an end of flat heat transfer tube 24 beyond rib 25. This structure is achieved by setting a dimension E (a diameter) of stopper 26 greater than a dimension D (a depth) of rib 25 in the axial or longitudinal direction of flat, heat transfer tube 24 (e.g., a vertical direction in FIG. 9). Such ribs 25 and stoppers 26 may be formed readily by a single process, such as by pressing.

In this embodiment, similar to that described with respect to the first embodiment, rib 25 extending across the width of flat, heat transfer tube 24 primarily increases the strength of each end portion of tube 24, thereby preventing a deformation thereof Stopper 26 primarily regulates the tube insertion length of each end portion of flat, heat transfer tube 24 into tube insertion hole 13 or 18, by engaging holes 13 and 18 at the inner surface of tube insertion hole 13 or 18. Therefore, an increase of the strength of each end portion of flat, heat transfer tube 24 and a uniform tube insertion length of each end portion of flat, heat transfer tube 24 into tank 2 or 3 may be achieved simultaneously and effectively, and a higher performance heat exchanger, which has superior brazing strength and which may prevent an increase of flow resistance within tanks 2 and 3, may be realized.

Further, because at least a portion of stopper 26 extends toward an end of flat, heat transfer tube 24 beyond rib 25, when the end portion of heat transfer tube 24 is inserted into tube insertion hole 13 or 18 of tank 2 or 3, respectively, the outer edge of stopper 26 first comes into contact with the inner surface of tube insertion hole 13 or 18. Therefore, the insertion length of heat transfer tube 24 is regulated properly, and insertion to an excessive length may be prevented. Consequently, rib 25 does not receive an excessive stress from the inner surface of tube insertion hole 13 or 18, and the end portion of heat transfer tube 24 may not be deformed.

In addition, in this embodiment, because stoppers 26 may be disposed on either side of rib 25 in the transverse direction of rib 25, the orientation of flat, heat transfer tube 24, when the end portion of the tube is inserted into tube insertion hole 13 or 18, may be maintained properly.

Figure 11:
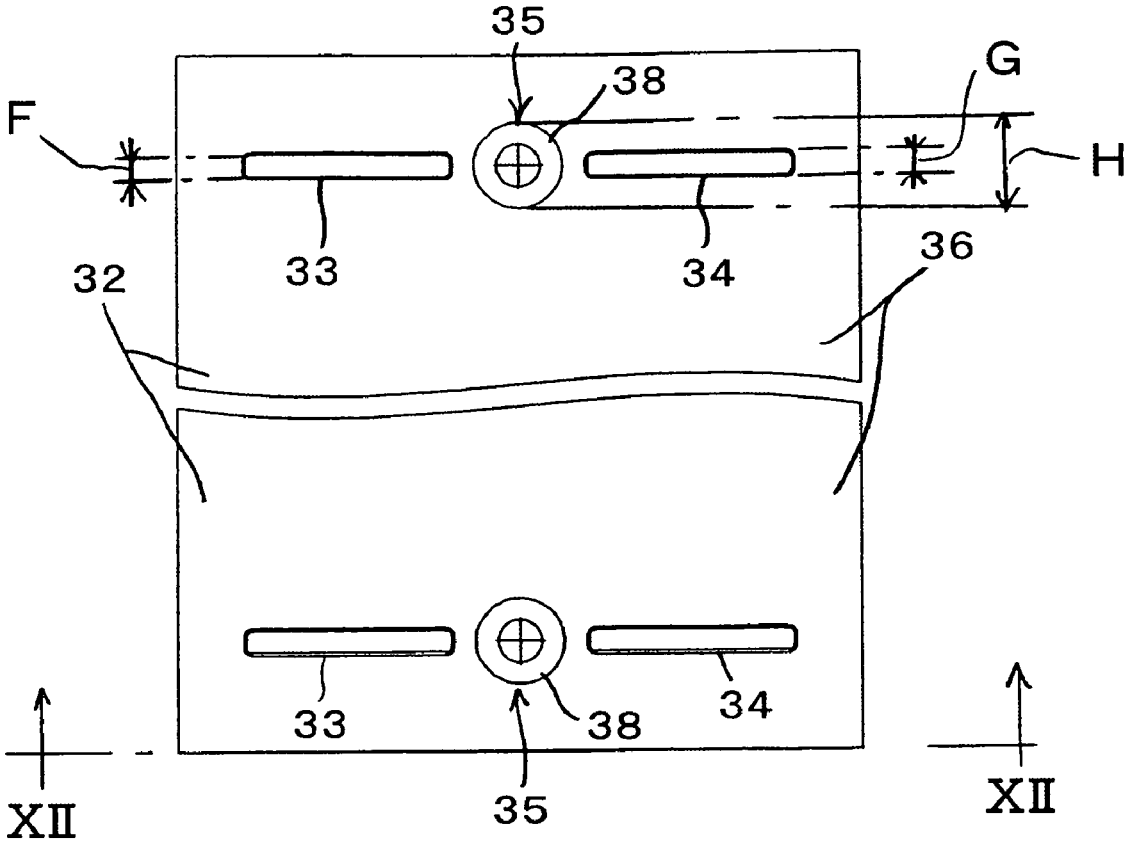
FIG. 11 is a partial, plan view of a flat, heat transfer tube of a heat exchanger according to a third embodiment of the present invention.
Figure 12:
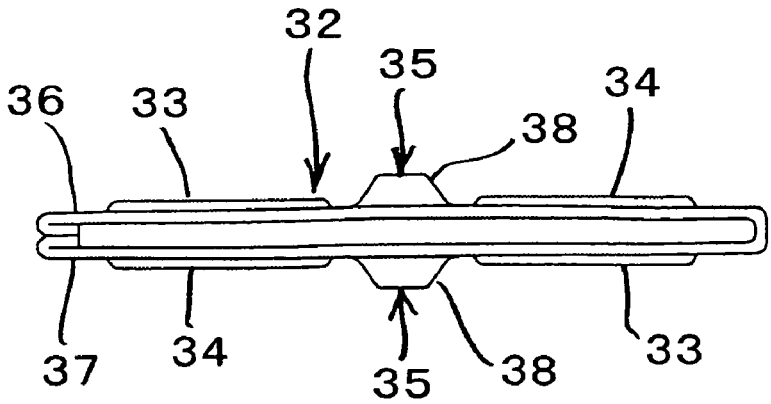
FIG. 12 is a cross-sectional view of the heat transfer tube depicted in FIG. 11, as viewed along line XII-XII of FIG. 11.

FIGS. 11 and 12 depict a flat, heat transfer tube 32 of a heat exchanger 1 according to a third embodiment of the present invention. In this embodiment, ribs 33 and 34 and stoppers 35 are disposed on either surface 36 and 37 of each end portion of each flat, heat transfer tube 32. Ribs 33 and 34 protrude from the tube surface in an outward direction from heat transfer tube 32. Each stopper 35 regulates a tube insertion length of each heat transfer tube 32 into tube insertion hole 13 or 18 of tank 2 or 3, respectively.

Figure 13:
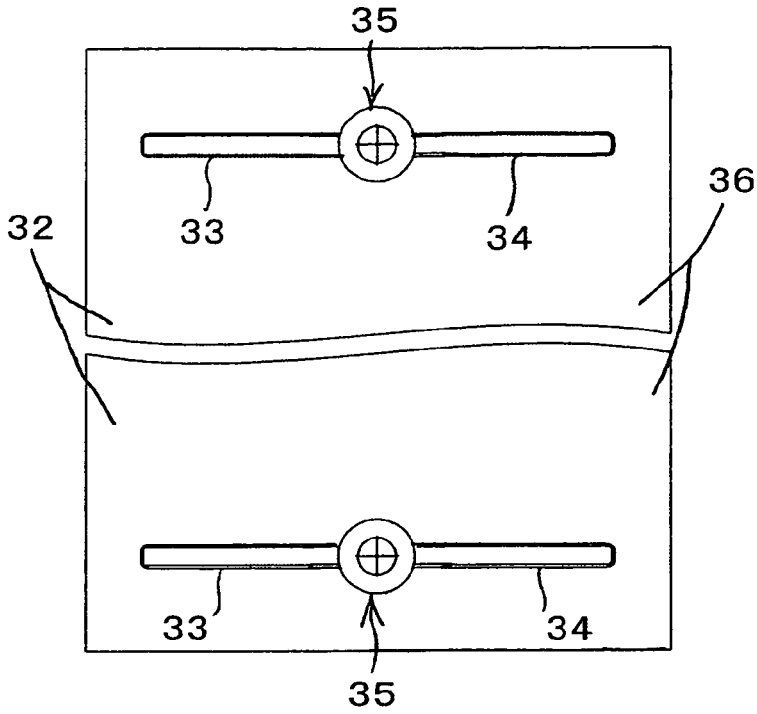
FIG. 13 is a partial, plan view of a flat, heat transfer tube of a heat exchanger according to a modification of the third embodiment of the present invention.
Figure 14:
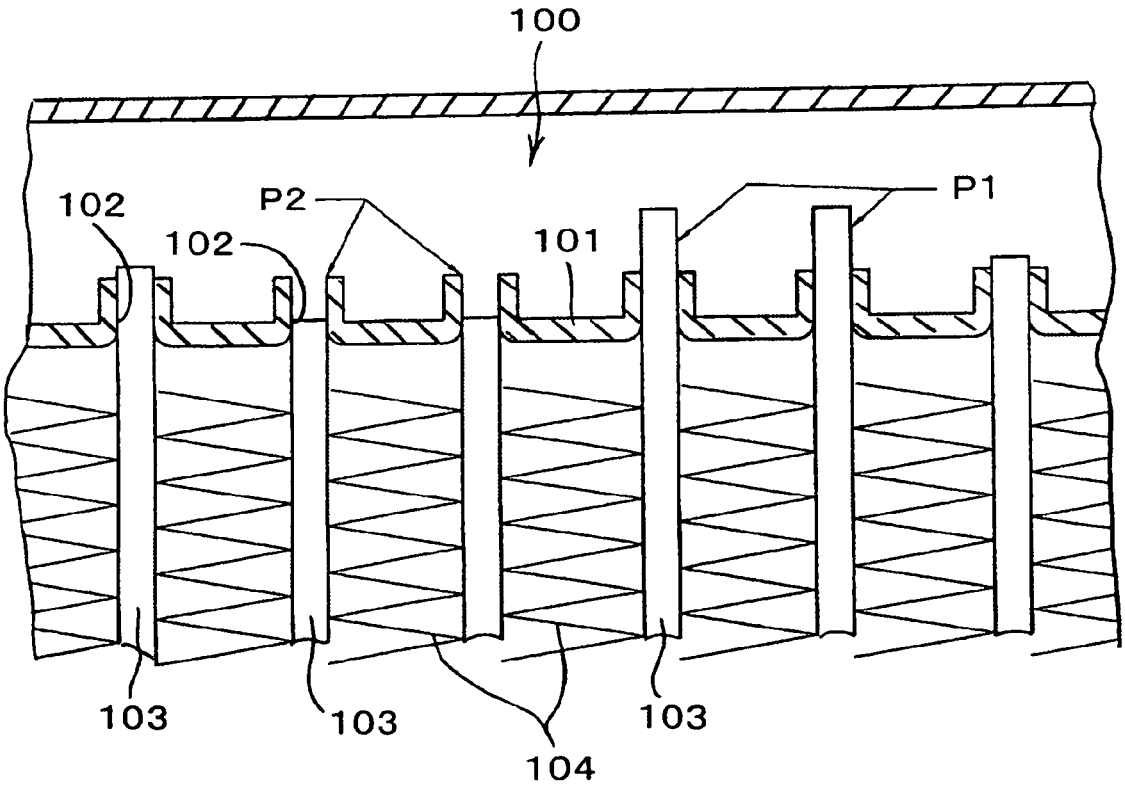
FIG. 14 PRIOR ART
FIG. 14 is a partial, cross-sectional view of a known heat exchanger, showing a plurality of flat, heat transfer tubes into inserted tube insertion holes of a tank.
Figure 15:
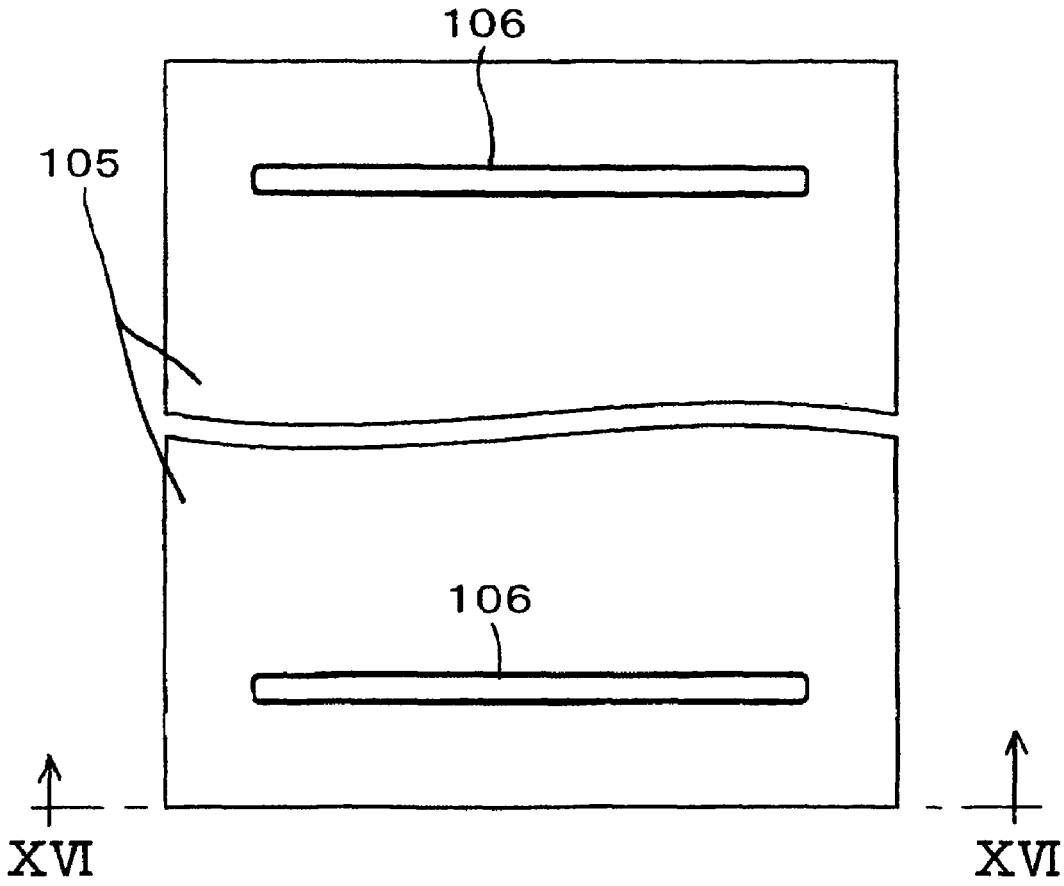
FIG. 15 PRIOR ART
FIG. 15 is a partial, plan view of a flat, heat transfer tube of another known heat exchanger.
Figure 16:
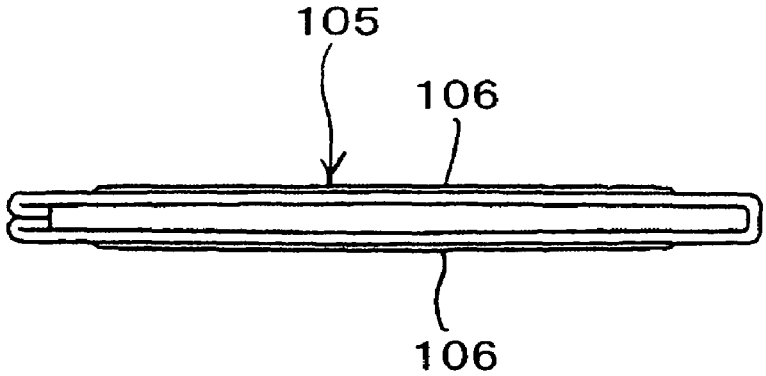
FIG. 16 PRIOR ART
FIG. 16 is a cross-sectional view of the heat transfer tube depicted in FIG. 15, as viewed along line XVI-XVI of FIG. 15.
Figure 17:
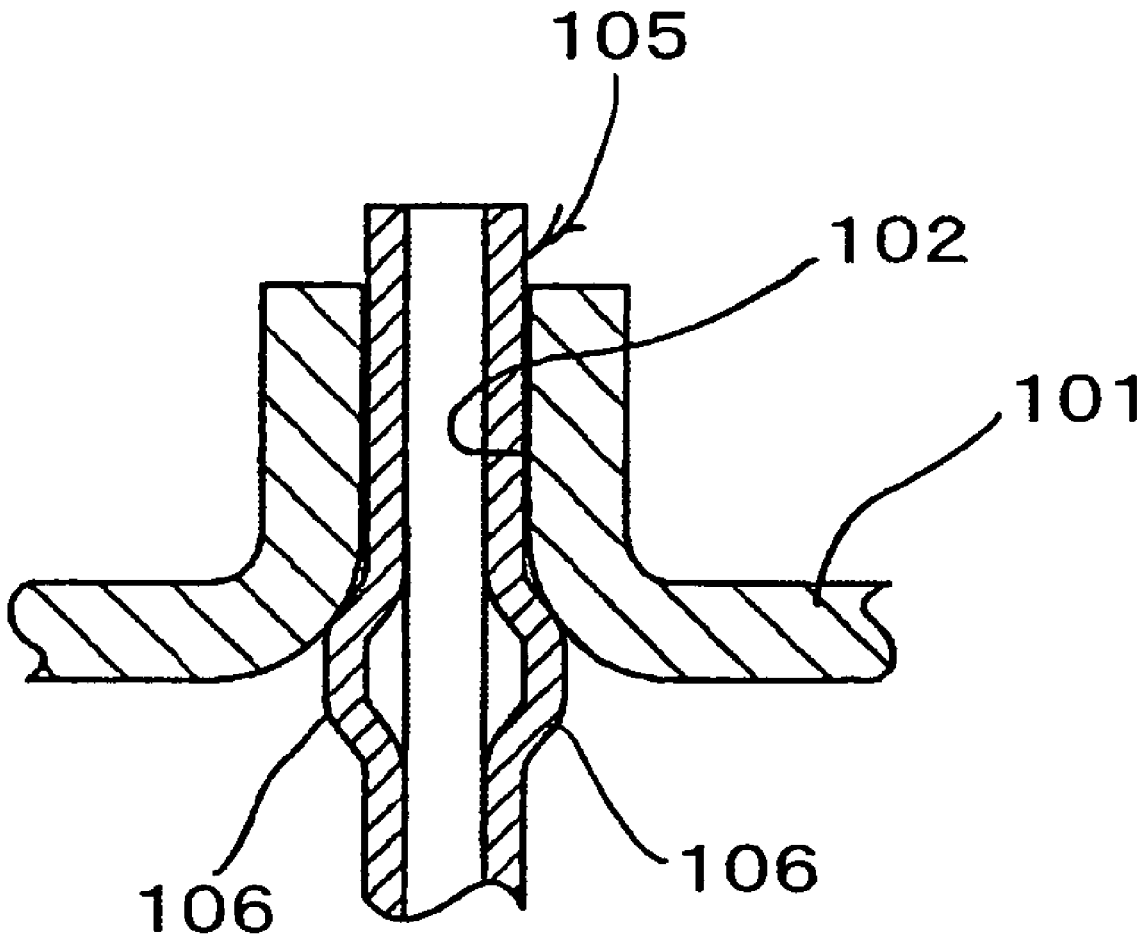
FIG. 17 PRIOR ART
FIG. 17 is an enlarged, partial, cross-sectional view of the heat transfer tube depicted in FIG. 15, showing a flat, heat transfer tube inserted into a tube insertion hole of a tank.

In this embodiment, two ribs 33 and 34, extending across a width of flat, heat transfer tube 32 (e.g., a left/right direction in FIG. 11), are disposed in series across the width of flat, heat transfer tube 32. Stopper 35 is a convex-shaped protrusion 38 from the tube surface in the outward direction of flat, heat transfer tube 32. Stopper 35 is provided between ribs 33 and 34 across the width of flat, heat transfer tube 32. Ribs 33 and 34 and stopper 35 are independent or separated from each other. Nevertheless, as shown in a modification of the third embodiment depicted in FIG. 13, ribs 33 and 34 and stopper 35 also may be connected to each other.

At least a portion of stopper 35 extends toward an end of flat, heat transfer tube 32 beyond ribs 33 and 34. This structure is achieved by setting a dimension H (a diameter) of stopper 35 greater than dimensions F and G (depths) of ribs 33 and 34 in the axial or longitudinal direction of flat, heat transfer tube 32 (e.g., a vertical direction in FIG. 11). Such ribs 33 and 34 and stoppers 35 may be formed readily by a single process, such as by pressing.

In addition, in this embodiment, similarly to in the aforementioned first and second embodiments, ribs 33 and 34 extending across the width of flat, heat transfer tube 32 primarily increase the strength of each end portion of tube 32, thereby preventing a deformation thereof Stopper 35 primarily regulates the tube insertion length of each end portion of flat, heat transfer tube 32 into tube insertion hole 13 or 18, by engaging stopper 35 with the inner surface of tube insertion hole 13 or 18. Therefore, an increase of the strength of each end portion of flat, heat transfer tube 32 and a uniform tube insertion length of each end portion of flat, heat transfer tube 32 into tank 2 or 3 may be achieved simultaneously and effectively, and a higher performance heat exchanger, which has superior brazing strength and which may prevent an increase of flow resistance within tanks 2 and 3, may be realized.

Further, because at least a portion of stopper 35 extends toward an end of flat, heat transfer tube 32 beyond ribs 33 and 34, when the end portion of heat transfer tube 32 is inserted into tube insertion hole 13 or 18 of tank 2 or 3, respectively, the outer edge of stopper 35 first comes into contact with the inner surface of tube insertion hole 13 or 18. Therefore, the insertion length of heat transfer tube 32 is regulated properly, and insertion to an excessive length may be prevented. Consequently, ribs 33 and 34 do not receive an excessive stress from the inner surface of tube insertion hole 13 or 18, and the end portion of heat transfer tube 32 may not be deformed.

Although embodiments of the present invention have been described in detail herein, the scope of the invention is not limited thereto. It will be appreciated by those skilled in the art that various modifications may be made without departing from the scope of the invention. Accordingly, the embodiments disclosed herein are only exemplary. It is to be understood that the scope of the invention is not to be limited thereby, but is to be determined by the claims which follow.

What is claimed is:

1. A heat exchanger comprising:

a first tank;

a second tank;

a plurality of flat heat transfer tubes connected to the first tank and to the second tank, wherein the plurality of flat heat transfer tubes are parallel to each other and are configured to be in fluid communication with the first tank and the second tank;

at least one rib, wherein each of the at least one rib extends from one of an outer surface and an inner surface of one of the plurality of heat transfer tubes; and at least one stopper extending from the outer surface of the one of the plurality of flat heat transfer tubes, wherein each of the at least one stopper is positioned between one of the at least one rib and one of the first tank and the second tank, and wherein each of the at least one stopper contacts one of the first tank and the second tank.

2. The heat exchanger according to claim 1, wherein each of the plurality of flat heat transfer tubes has a length and a width which is less than the length; and each of the at least one rib extends further in the width direction of the one of the plurality of flat heat exchanger tubes than in the length direction of the one of the plurality of flat heat transfer tubes.

3. The heat exchanger according to claim 2, wherein at least a portion of the at least one stopper is positioned closer to the first tanks than the at least one rib is positioned to the first tank.

4. The heat exchanger according to claim 1, wherein each of the plurality of flat heat transfer tubes has a length and a width which is less than the length;

the at least one rib comprises a first end and a second end in the width direction of the one of the plurality of heat transfer tubes;

the second end of the at least one rib is opposite the first end of the at least one rib in the width direction of the one of the plurality of heat transfer tubes;

a first stopper of the at least one stopper is positioned adjacent to the first end of the at least one rib; and a second stopper of the at least one stopper is positioned adjacent to the second end of the at least one rib.

5. The heat exchanger according to claim 1, wherein a plurality of ribs are disposed on said surface of said end portion of said heat transfer tube, and said stopper is disposed between ribs.

6. The heat exchanger according to claim 1, wherein the at least one stopper has a convex shape and extends from the outer surface of the one of the plurality of flat heat transfer tubes.

7. The heat exchanger according to claim 1, wherein each of the plurality of flat heat transfer tubes has a length and a width which is less than the length; and the at least one stopper extends further along the length direction of the one of the plurality of flat heat transfer tubes than the at least one rib extends along the length direction of the one of the plurality of flat heat transfer tubes.

8. The heat exchanger according to claim 1, wherein said rib and said stopper are connected to each other.

9. The heat exchanger according to claim 1, wherein the at least one rib and the at least one stopper are separated from each other.

10. An air conditioning system comprising:

a heat exchanger, wherein the heat exchanger comprises:

a first tank;

a second tank;

a plurality of flat heat transfer tubes connected to the first tank and to the second tank, wherein the plurality of flat heat transfer tubes are parallel to each other and are configured to be in fluid communication with the first tank and the second tank;

at least one rib, wherein each of the at least one rib extends from one of an outer surface and an inner surface of one of the plurality of heat transfer tubes; and at least one stopper extending from the outer surface of the one of the plurality of flat heat transfer tubes, wherein each of the at least one stopper is positioned between one of the at least one rib and one of the first tank and the second tank, and wherein each of the at least one stopper contacts one of the first tank and the second tank.

11. The air conditioning system according to claim 10, wherein each of the plurality of flat heat transfer tubes has a length and a width which is less than the length; and each of the at least one rib extends further in the width direction of the one of the plurality of flat heat exchanger tubes than in the length direction of the one of the plurality of flat heat transfer tubes.

12. The air conditioning system according to claim 10, wherein each of the plurality of flat heat transfer tubes has a length and a width which is less than the length;

the at least one rib comprises a first end and a second end in the width direction of the one of the plurality of heat transfer tubes;

the second end of the at least one rib is opposite the first end of the at least one rib in the width direction of the one of the plurality of heat transfer tubes;

a first stopper of the at least one stopper is positioned adjacent to the first end of the at least one rib; and a second stopper of the at least one stopper is positioned adjacent to the second end of the at least one rib.

13. The air conditioning system according to claim 10, wherein a plurality of ribs are disposed on said surface of said end portion of said heat transfer tube, and said stopper is disposed between ribs.

14. The air conditioning system according to claim 10, wherein the at least one stopper has a convex shape and extends from the outer surface of the one of the plurality of flat heat transfer tubes.

15. The air conditioning system according to claim 10, wherein at least a portion of the at least one stopper is positioned closer to the first tanks than the at least one rib is positioned to the first tank.

16. The air conditioning system according to claim 10, wherein each of the plurality of flat heat transfer tubes has a length and a width which is less than the length; and the at least one stopper extends further along the length direction of the one of the plurality of flat heat transfer tubes than the at least one rib extends along the length direction of the one of the plurality of flat heat transfer tubes.

17. The air conditioning system according to claim 10, wherein said rib and said stopper are connected to each other.

18. The air conditioning system according to claim 10, wherein the at least one rib and the at least one stopper are separated from each other.

* * * * *